US010533392B2

(12) United States Patent
Walton et al.

(10) Patent No.: US 10,533,392 B2
(45) Date of Patent: Jan. 14, 2020

(54) DEGRADABLE EXPANDING WELLBORE ISOLATION DEVICE

(71) Applicant: Halliburton Energy Services, Inc., Houston, TX (US)

(72) Inventors: Zachary William Walton, Carrollton, TX (US); Michael Linley Fripp, Carrollton, TX (US); John Charles Gano, Lowry Crossing, TX (US); Zachary Ryan Murphree, Dallas, TX (US); David Allen Dockweiler, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 157 days.

(21) Appl. No.: 15/554,697

(22) PCT Filed: Apr. 1, 2015

(86) PCT No.: PCT/US2015/023785

§ 371 (c)(1),
(2) Date: Aug. 30, 2017

(87) PCT Pub. No.: WO2016/160003

PCT Pub. Date: Oct. 6, 2016

(65) Prior Publication Data

US 2018/0038193 A1 Feb. 8, 2018

(51) Int. Cl.
*E21B 23/06* (2006.01)
*E21B 33/134* (2006.01)

(52) U.S. Cl.
CPC ..... *E21B 33/134* (2013.01); *E21B 23/06* (2013.01)

(58) Field of Classification Search
CPC ..... E21B 33/129; E21B 33/134; E21B 34/14; E21B 33/12; E21B 33/1204; E21B 33/1293
See application file for complete search history.

(56) References Cited

U.S. PATENT DOCUMENTS 3,298,440 A * 1/1967 Current ..... E21B 23/06 166/123
4,132,498 A * 1/1979 Ikeda ..... E02D 5/765 405/259.4

(Continued)

FOREIGN PATENT DOCUMENTS

WO WO-2013/022635 A2 2/2013
WO WO-2014/100072 A1 6/2014
WO WO-2016/036371 A1 3/2016

OTHER PUBLICATIONS

International Search Report and Written Opinion from PCT/US2015/023785, dated Dec. 30, 2015, 17 pages.

*Primary Examiner* — Daniel P Stephenson
(74) *Attorney, Agent, or Firm* — McGuireWoods LLP

(57) ABSTRACT

A wellbore isolation device includes a wedge member that defines an outer surface and a barrel seal having a cylindrical body that provides an inner radial surface and an outer radial surface. The inner radial surface is engageable with the outer surface of the wedge member. The barrel seal further includes a plurality of longitudinally extending grooves defined through the body in an alternating configuration at opposing ends of the body. A raised lip protrudes radially from the outer radial surface and circuitously extends about a circumference of the body. A plurality of slip buttons is positioned in a corresponding plurality of holes defined in the outer radial surface of the body. At least one of the wedge member and the barrel seal is made of a degradable material that degrades when exposed to a wellbore environment.

20 Claims, 4 Drawing Sheets

(56) References Cited

U.S. PATENT DOCUMENTS

| | | | | |
|---|---|---|---|---|
| 8,191,633 | B2 * | 6/2012 | Frazier | E21B 34/063 166/133 |
| 9,777,550 | B2 * | 10/2017 | Doane | E21B 33/1208 |
| 9,835,003 | B2 * | 12/2017 | Harris | E21B 23/01 |
| 10,000,991 | B2 * | 6/2018 | Harris | E21B 33/1291 |
| 2005/0069691 | A1 | 3/2005 | Sutton et al. | |
| 2008/0191420 | A1 * | 8/2008 | Imhoff | E21B 23/01 277/315 |
| 2011/0024134 | A1 | 2/2011 | Buckner | |
| 2011/0186306 | A1 | 8/2011 | Marya et al. | |
| 2012/0118561 | A1 | 5/2012 | Frazier | |
| 2013/0186649 | A1 * | 7/2013 | Xu | E21B 23/01 166/382 |
| 2014/0014371 | A1 | 1/2014 | Jacob et al. | |
| 2014/0209325 | A1 * | 7/2014 | Dockweiler | E21B 33/129 166/382 |
| 2018/0038193 | A1 * | 2/2018 | Walton | E21B 33/134 |
| 2018/0313184 | A1 * | 11/2018 | Merron | E21B 33/128 |

* cited by examiner

DEGRADABLE EXPANDING WELLBORE ISOLATION DEVICE

BACKGROUND

In the drilling, completion, and stimulation of hydrocarbon-producing wells, a variety of downhole tools are used. For example, it is often desirable to seal portions of a wellbore targeted for treatment. During fracturing operations, for instance, various fluids and slurries are pumped from the surface into a casing string and forced out into a surrounding subterranean formation, but only certain desired zones of interest should receive the fracturing fluid. It thus becomes necessary to seal the wellbore and thereby provide zonal isolation to target the treatment to the desired zone(s). Wellbore isolation devices, such as packers, bridge plugs, and fracturing plugs (i.e., "frac" plugs) are designed for these general purposes and are well known in the art of producing hydrocarbons, such as oil and gas. Such wellbore isolation devices may be used in direct contact with the formation face of the wellbore, with a casing string extended and secured within the wellbore, or with a screen or wire mesh.

After the desired downhole operation is complete, the seal formed by the wellbore isolation device must be broken and the downhole tool removed from the wellbore to allow hydrocarbon production operations to commence without being hindered by the presence of the downhole tool. Removing wellbore isolation devices, however, is traditionally accomplished by a complex retrieval operation that involves milling or drilling out a portion of the wellbore isolation device, and subsequently mechanically retrieving its remaining portions. To accomplish this, a mill or drill bit is attached to the distal end of a work string and conveyed into the wellbore until locating the wellbore isolation device, at which point the wellbore isolation device may be milled or drilled out. After drilling out the wellbore isolation device, the remaining portions of the wellbore isolation device may be grasped onto and retrieved back to the surface with the work string for disposal.

As can be appreciated, this retrieval operation can be a costly and time-consuming process. Consequently, wellbore isolation devices are increasingly being manufactured of degradable or dissolvable materials that dissolve under certain wellbore conditions or in the presence of certain wellbore fluids, and thereby preclude the need to drill or mill out the wellbore isolation device. Traditional wellbore isolation devices, however, can include up to thirty or more structural elements or components, each of which needs to be made of a degradable material and designed to degrade at a predetermined rate or within a predetermined time period. In practice, some component parts will dissolve quicker than others, which could lead to pre-mature release within the wellbore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

The present disclosure is related to downhole tools used in the oil and gas industry and, more particularly, to simplified wellbore isolation devices that are degradable in a wellbore environment.

Embodiments of the present disclosure provide a wellbore isolation device that uses a combined slip and seal system for hydraulically sealing off a portion of a wellbore. The wellbore isolation device may include a wedge member that defines an outer surface and a barrel seal that has a cylindrical body that provides an inner radial surface and an outer radial surface. The inner radial surface of the barrel seal may be engageable with the outer surface of the wedge member. The barrel seal may further include a plurality of longitudinally extending grooves defined through the body in an alternating configuration at opposing ends of the body. The grooves allow the barrel seal to expand like a spring upon slidingly engaging the outer surface of the wedge member. A raised lip protrudes radially from the outer radial surface and circuitously extends about a circumference of the body. The raised lip may plastically deform against an inner wall of a casing to provide a seal within the wellbore. A plurality of slip buttons is positioned in a corresponding plurality of holes defined in the outer radial surface of the body and used to grippingly engage the inner wall of a casing. Moreover, at least one of the wedge member and the barrel seal is made of a degradable material that degrades when exposed to a wellbore environment.

Advantages of the presently described wellbore isolation devices are that there are fewer component parts as compared to prior art wellbore isolation devices. Fewer component parts will allow for more controlled dissolution characteristics for the wellbore isolation device. Moreover, since there are fewer component parts, the wellbore isolation device may exhibit a larger inner diameter, which may prove advantageous for increasing flow rates during production operations. The wellbore isolation devices of the present application do not include elastomeric elements, which may allow for maximum run-in speeds to desired locations within the wellbore. Lastly, because of the raised lip plastically deforming against the inner wall of the casing, the wellbore isolation device may be set practically anywhere within the casing, even in locations where there is a defect or deformity in the casing.

Figure 1:
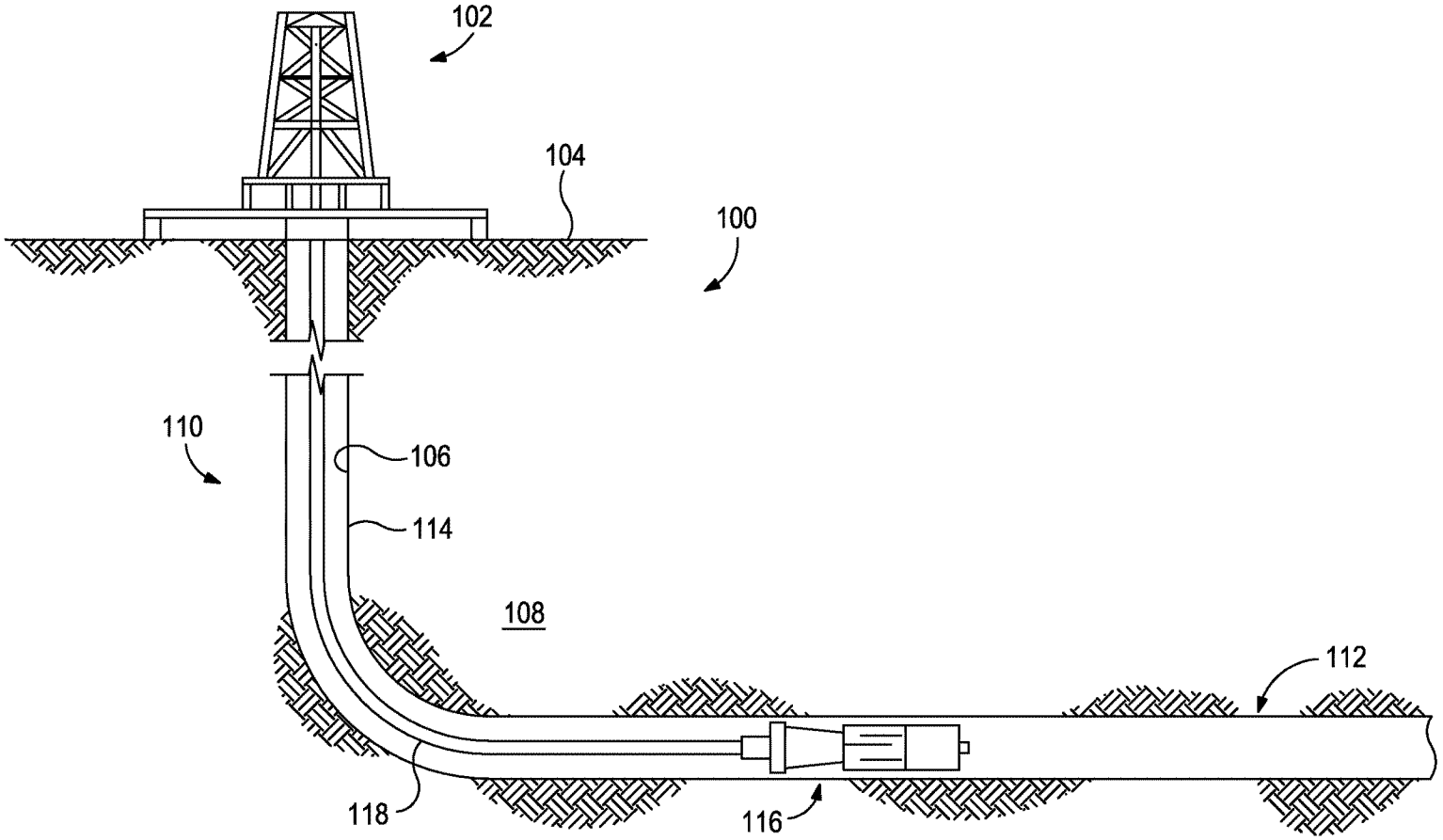
FIG. 1 illustrates a well system that can employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation, without departing from the scope of the disclosure. Moreover, while the well system 100 is depicted as a land-based operation, it will be appreciated that the principles of the present disclosure could equally be applied in any sea-based or sub-sea application where the service rig 102 may be a floating platform, a semi-submersible platform, or a sub-surface wellhead installation as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. In other embodiments, however, the casing string 114 may be omitted from all or a portion of the wellbore 106 and the principles of the present disclosure may equally apply to an "open-hole" environment.

The system 100 may further include a wellbore isolation device 116 that may be conveyed into the wellbore 106 on a conveyance 118 that extends from the service rig 102. As described in greater detail below, the wellbore isolation device 116 may operate as a type of casing or borehole isolation device, such as a frac plug, a bridge plug, a wellbore packer, a wiper plug, a cement plug, or any combination thereof. The conveyance 118 that delivers the wellbore isolation device 116 downhole may be, but is not limited to, wireline, slickline, an electric line, coiled tubing, drill pipe, production tubing, or the like.

The wellbore isolation device 116 may be conveyed downhole to a target location (not shown) within the wellbore 106. In some embodiments, the wellbore isolation device 116 is pumped to the target location using hydraulic pressure applied from the service rig 102 at the surface 104. In such embodiments, the conveyance 118 serves to maintain control of the wellbore isolation device 116 as it traverses the wellbore 106 and may provide power to actuate and set the wellbore isolation device 116 upon reaching the target location. In other embodiments, the wellbore isolation device 116 freely falls to the target location under the force of gravity to traverse all or part of the wellbore 106. At the target location, the wellbore isolation device may be actuated or "set" to seal the wellbore 106 and otherwise provide a point of fluid isolation within the wellbore 106.

It will be appreciated by those skilled in the art that even though FIG. 1 depicts the wellbore isolation device 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well.

Figure 2:
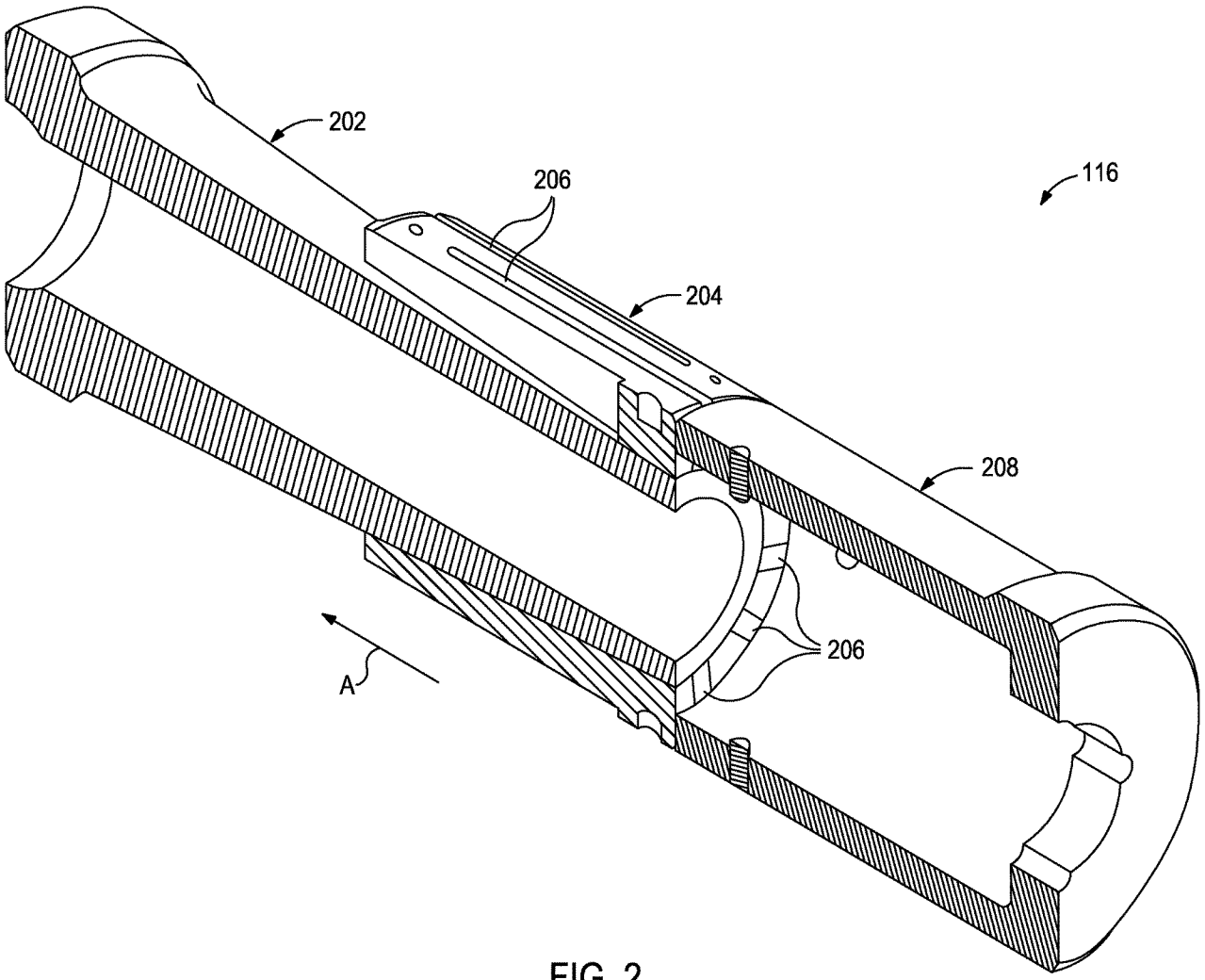
FIG. 2 is a cross-sectional isometric view of the wellbore isolation device of FIG. 1.

Referring now to FIG. 2, with continued reference to FIG. 1, illustrated is a cross-sectional isometric view of the wellbore isolation device 116, according to one or more embodiments. As illustrated, the wellbore isolation device 116 (hereafter "the device 116") may include a wedge member 202 and a barrel seal 204. The barrel seal 204 may include an inner diameter sized to receive at least a portion of the wedge member 202. In some embodiments, as illustrated, the outer surface of the wedge member 202 and the inner radial surface of the barrel seal 204 may be complimentarily tapered or angled and otherwise configured to slidably engage one another in setting the barrel seal 204 in a wellbore (e.g., the wellbore 106 of FIG. 1). As described in more detail below, the barrel seal 204 may comprise a one-piece slip structure that defines a plurality of longitudinally-extending grooves 206 that allow the barrel seal 204 to radially expand as it moves with respect to the wedge member 202, such as in the direction A.

In some embodiments, the device 116 may further include a setting sleeve 208 configured to engage an end of the barrel seal 204. As discussed below, the setting sleeve 208 may be coupled to a setting tool (not shown) that may be actuated to axially contract the device 116. In such embodiments, the setting tool may be actuated to force the setting sleeve 208 against the barrel seal 204 such that the barrel seal 204 slides along the tapered outer surface of the wedge member 202 in the direction A. As the barrel seal 204 moves in the direction A with respect to the wedge member 202, the barrel seal 204 may radially expand, such as into engagement with the inner wall of a casing (e.g., the casing string 114 of FIG. 1). In other embodiments, however, the setting sleeve 208 may be omitted from the device 116 and the setting tool may alternatively engage the barrel seal 204 (directly or indirectly) and otherwise force the barrel seal 204 up the tapered outer surface of the wedge member 202 such that it radially expands into its set position.

Figure 3:
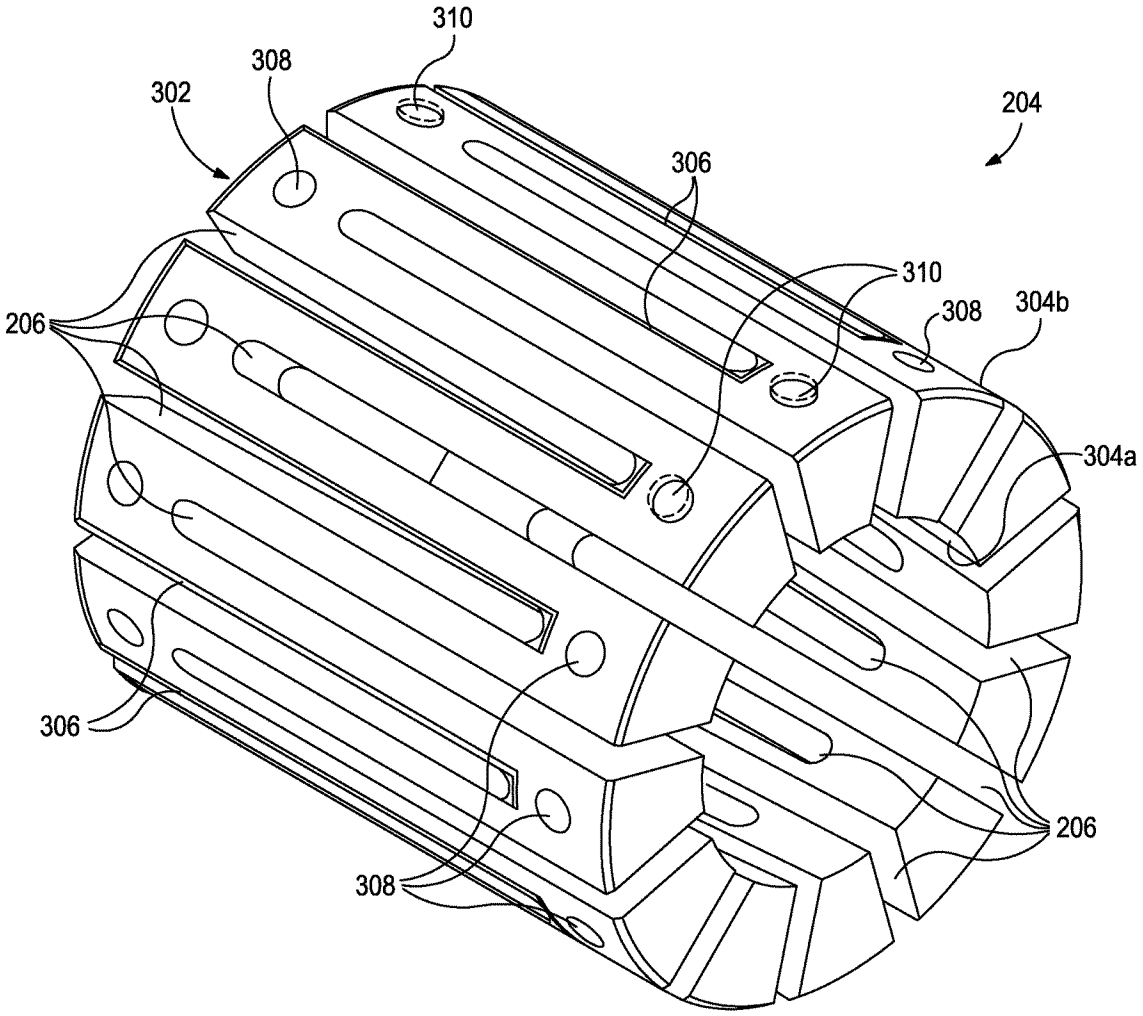
FIG. 3 is an isometric view of an exemplary embodiment of the barrel seal of FIG. 2.

FIG. 3 is an isometric view of an exemplary embodiment of the barrel seal 204 of FIG. 2. As illustrated, the barrel seal 204 may include a generally cylindrical body 302 having an inner radial surface 304*a* and an opposing outer radial surface 304*b*. As mentioned above, the inner radial surface 304*a* may be angled or tapered and configured to mate with the correspondingly angled or tapered outer surface of the wedge member 202 (FIG. 2). Moreover, as the barrel seal 204 is radially expanded during operation, the outer radial surface 304*b* may be forced into engagement with the inner wall of a casing (e.g., the casing string 114 of FIG. 1).

As briefly mentioned above, a plurality of longitudinally extending grooves 206 may be defined or otherwise provided in the body 302 of the barrel seal 204. As illustrated, the grooves 206 may be defined through the body 302 from the inner radial surface 304*a* to the outer radial surface 304*b* at each end of the body 302 in an alternating configuration. More particularly, one groove 306 may be defined in the body 302 at one end and an angularly adjacent groove 306 may be defined in the body 302 at the opposing end. As a result, the body 302 may comprise a continuous, serpentine structure or configuration that circuitously winds around the grooves 206. Such a serpentine configuration allows the body 302 to radially expand like a spring and otherwise assume a diameter change with little or no plastic deformation.

In some embodiments, the barrel seal 204 may further include a raised lip 306 that protrudes proximate or radially a short distance from the outer radial surface 304*b* of the body 302. As illustrated, the raised lip 306 may generally extend along and otherwise follow the serpentine outline of the alternating grooves 206. Consequently, the raised lip 306 may form a continuous raised structure that circuitously extends about the circumference of the barrel seal 204. In at least one embodiment, the raised lip 306 may comprise a high-strength material, such as a metal wire that is welded, glued, coined, and/or brazed onto the outer radial surface 304*b* or positioned in a groove (not shown) defined on the outer radial surface 304*b*. In other embodiments, the raised lip 306 may be an integral part of the barrel seal 204 that is formed concurrently with the body 302. In yet other embodiments, the raised lip 306 may comprise a soft metal or an elastomer that is bonded or affixed onto the outer radial surface 304*b* or positioned in a groove (not shown) defined on the outer radial surface 304*b*.

In operation, as the barrel seal 204 is radially expanded and forced into contact with the inner wall of a casing (e.g., the casing string 114 of FIG. 1), the raised lip 306 may provide a high-stress contact between the barrel seal 204 and the casing. For instance, the raised lip 306 may generate brinneling of the barrel seal 204 or the inner wall of the casing, which may result in an enhanced pressure seal at that location. More specifically, portions of the raised lip 306 may be plastically deformed and otherwise brinnelled into the inner wall of the casing to create the seal. As will be appreciated, this may prove advantageous in not only securing the wellbore isolation device 116 within the wellbore, but also accommodating applications where the inner wall of the casing is not smooth or perfectly round. In such applications, the raised lip 306 may be forced into any imperfections in the inner wall of the casing to generate the seal. Moreover, in embodiments where the raised lip 306 comprises a softer metal or an elastomer, the raised lip 306 may form a seal within the wellbore upon engaging the inner wall of the casing.

As illustrated, the barrel seal 204 may further define and otherwise provide a plurality of holes 308 in the body 302. In some embodiments, some or all of the holes 308 may receive a corresponding slip button 310 (three shown in phantom dashed lines). The slip buttons 310 may radially protrude a short distance past the outer radial surface 304*b* and may comprise gripping elements configured to engage and bite into the inner wall of a casing when the barrel seal 204 radially expands. In at least one embodiment, the slip buttons 310 and the raised lip 306 may radially protrude from the outer radial surface 304*b* the same or substantially the same distance. In other embodiments, however, one of the slip buttons 310 and the raised lip 306 may radially protrude further than the other, without departing from the scope of the disclosure.

The slip buttons 310 may be made of any hard material such as, but not limited to, ceramic, natural diamonds, synthetic diamonds, a carbide, a metal, a degradable material, or any combination thereof. Suitable carbides that may be used as the slip buttons 310 include, but are not limited to, cemented carbide, spherical carbides, cast carbides, silicon carbide, boron carbide, cubic boron carbide, molybdenum carbide, titanium carbide, tantalum carbide, niobium carbide, chromium carbide, vanadium carbide, iron carbide, tungsten carbide, macrocrystalline tungsten carbide, cast tungsten carbide, crushed sintered tungsten carbide, and carburized tungsten carbide. In some embodiments, one or more of the slip buttons 310 may comprise distributed particles on the outer surface 304*b* of the barrel seal 304. In such embodiments, the holes 308 may be omitted and the slip buttons 310 may comprise a crushed or shaped material that is pressed into or otherwise bonded to the exterior of the barrel seal 204. Moreover, it will be appreciated that the size, shape, and distribution of the slip buttons 310 are not limited to typical round cylinders. Rather, the slip buttons 310 may be polygonal (e.g., pyramidal, cubic, etc.) or may alternatively comprise crushed and/or sized material.

Figure 4A:
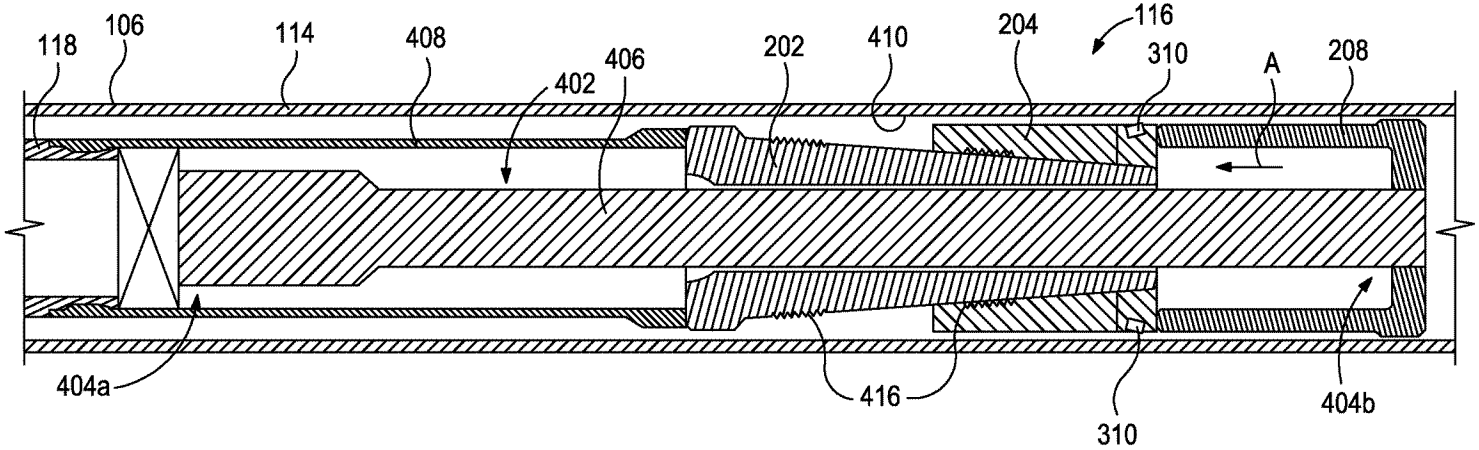
FIGS. 4A and 4B are cross-sectional side views of the device in a run-in configuration and a set configuration, respectively.
Figure 4B:
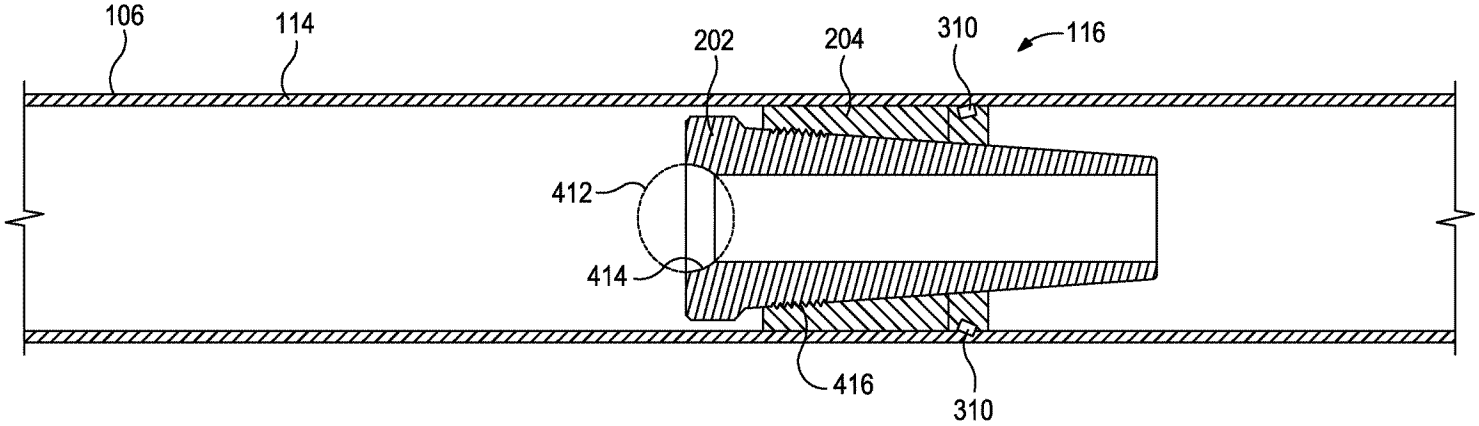

Referring now to FIGS. 4A and 4B, with continued reference to the prior figures, illustrated are cross-sectional side views of the device 116, according to one or more embodiments. More particularly, FIG. 4A depicts the device 116 in a first or run-in configuration, and FIG. 4B depicts the device 116 in a second or set configuration. In the run-in configuration, the outer diameter of the device 116 may be small enough to allow the device 116 to traverse the wellbore 106 until arriving at a target location. As illustrated in FIG. 4A, the device 116 may be run into the wellbore 106 on the conveyance 118 until reaching a designated portion of the wellbore 106 that is lined with the casing 114.

In some embodiments, the conveyance 118 may be coupled to the device 116 using a setting tool 402, such as a downhole power unit. As illustrated, the setting tool 402 may comprise an upper end 404*a*, a lower end 404*b*, and a collapsible body 406 that extends between the upper and lower ends 404*a,b* and generally extends through the device 116. At the upper end 404*a*, the setting tool 402 may include an upper sleeve 408 configured to engage an upper end of the wedge member 202. At the lower end 404*b*, the setting tool 402 may be operatively coupled to the setting sleeve 208 (if used). In embodiments where the setting sleeve 208 is omitted from the device 116, the setting tool 402 may alternatively be operatively coupled to the lower end of the barrel seal 204, without departing from the scope of the disclosure. As used herein, the term "operatively coupled" refers to a direct or indirect coupling of one component to another, such as a direct or indirect coupling of the setting tool 402 to the barrel seal 204.

The setting tool 402 may be actuatable to reduce the axial length of the device 116 and thereby set the barrel seal 204 against an inner wall 410 of the casing 114. More particularly, in exemplary operation, the setting tool 402 may be activated to pull the setting sleeve 208 in the direction A, which forces the barrel seal 204 to slidingly engage the outer surface of the wedge member 202 in the same direction. Alternatively, or in addition thereto, the setting tool 402 may be configured to apply opposing forces in the direction A and an opposing direction to force the barrel seal 204 to slidingly engage the outer surface of the wedge member 202. The setting tool 402 is biased against the upper end of the wedge member 202 at the upper sleeve 408 and is thereby maintained substantially in place as the barrel seal 204 moves in the direction A.

As indicated above, moving the barrel seal 204 in the direction A allows the complimentarily tapered outer and inner surfaces of the wedge member 202 and the barrel seal 204, respectively, to slidingly engage each other and thereby radially expand the barrel seal 204 into engagement with the inner wall 410 of the casing 114. The tapered outer surface of the wedge member 202 may be angled and otherwise configured to obtain a uniform expansion of the barrel seal 204 during actuation of the setting tool 402. Once the barrel seal 204 is moved into radial engagement with the inner wall 410 of the casing 114, the barrel seal 204 may temporarily hold the device 116 in place in the wellbore 106 while the setting tool 402 is detached from the setting sleeve 208 and retracted back to the surface 104 (FIG. 1). The radial load between the wedge member 202 and the barrel seal 204 may help maintain the two components mated together once the setting tool 402 is detached. Furthermore, once detached from the setting tool 402, the setting sleeve 208 may fall freely within the wellbore 106 to dissolve over time or may be configured to be retained for the possibility of milling out during a later operation.

As shown in FIG. 4B, the barrel seal 204 is depicted in the set configuration and otherwise engaged against the inner wall 410 of the casing 114 and the setting tool 402 has been retracted. Once the setting tool 402 is detached and removed, a wellbore projectile 412, such as a ball or a dart, may be conveyed and otherwise pumped to the device 116 and may land on a seat 414 defined on the upper end of the wedge member 202. The wellbore projectile 412 may be configured to seal off the central passageway through the device 116 and, as a result, the wellbore projectile 412 may form a hydraulic seal that effectively converts the device 116 into a type of frac plug or bridge plug within the wellbore 106.

With the wellbore projectile 412 landed on the seat 414 and the barrel seal engaged against the inner wall 410 of the casing 114, increasing the fluid pressure within the casing 114 may force the wedge member 202 deeper inside the interior of the barrel seal 204, which may place an increased radial force on the barrel seal 204 against the inner wall 410. As the barrel seal 204 is forced radially against the inner wall 410 of the casing 114, the raised lip 306 (FIG. 3) on the barrel seal 204 may provide a high-stress contact between the barrel seal 204 and the casing 114. More particularly, at least a portion of the raised lip 306 may plastically deform and otherwise create a brinneling of the barrel seal 204 or the inner wall 410 of the casing 114, thereby providing an enhanced pressure seal at the location of the device 116 within the wellbore 106. As indicated above, this may prove advantageous in applications where the inner wall 410 of the casing 114 is not smooth or round, or when the casing 114 may be scratched and the raised lip 306 may be forced into such structural imperfections. As will be appreciated, forcing the barrel seal 204 radially against the inner wall 410 of the casing 114 to provide the high-stress contact between the barrel seal 204 and the casing 114 may alternatively be accomplished using the setting tool 402. In such embodiments, the wellbore projectile 412 may be omitted.

Furthermore, increasing the fluid pressure within the casing 114 may force the slip buttons 310 into gripping contact with the inner wall 410 of the casing 114. More particularly, the slip buttons 310 may also brinell into the inner wall 410 of the casing 114, and thereby provide slip resistance to the device 116 as secured within the wellbore 106. More particularly, the slip buttons 310 may brinell into both the casing 114 and the body 302 of the barrel seal 204 to satisfy the local loading condition and material properties of the body 302 and the inner wall 410. Moreover, this brinelling into the casing 114 adds to the retaining force potential corresponding to the friction and shear force the body 302 (and seal) to locate the device 116 against the applied pressure. With the slip buttons 310 and the raised lip 306 engaged with the inner wall 410 of the casing 114, and the wellbore projectile 412 sealing off the central passageway through the device 116, a well operator may initiate hydraulic fracturing operations within the wellbore 106 above the device 116. In such operations, the device 116 may act as a type of frac plug that prevents or restricts fluids from migrating downhole and past the device 116.

The wedge member 202 may be configured to mate with the inner diameter of the barrel seal 204. In some embodiments, for instance, the complimentarily tapered outer and inner surfaces of the wedge member 202 and the barrel seal 204, respectively, may comprise a sticking taper that prevents the wedge member 202 from disengaging from the barrel seal 204. The sticking taper, also known in the industry as a Morse taper or a machining taper, may comprise approximately a 0.5 inch taper per foot along the length of the wedge member 202. The sticking taper may be configured to lock and maintain the barrel seal 204 in the set configuration and also provide an enhanced radial load applied against the barrel seal 204. Accordingly, the term "sticking taper" as used herein refers to a wedging action maintained solely by virtue of the friction between cooperating tapering surfaces (e.g., the tapered outer and inner surfaces of the wedge member 202 and the barrel seal 204, respectively).

In some embodiments, the wedge member 202 may be mated to the inner diameter of the barrel seal 204 using one or more structural features defined on one or both of the wedge member 202 and the barrel seal 204. In at least one embodiment, for instance, the outer diameter of the wedge member 202 or the inner diameter of the barrel seal 204 may define a unique profile (not shown) and a corresponding profile key (not shown). When the profile key locates the profile, the setting stroke of the device 116 may be locked to hold the wedge member 202 and the barrel seal 204 in the fully set condition. In one or more embodiments, the profile and corresponding profile key may comprise angled grooves or ramped teeth 414, which, upon engagement, prevent the device 116 from retracting and otherwise moving from the set configuration back to the run-in configuration.

In some embodiments, some or all of the components of the device 116 may be made of a dissolving or degradable material configured to degrade or dissolve within the wellbore 106 environment. The components of the device 116 refer to at least the wedge member 202 and the barrel seal 204, but may also include the setting sleeve 208, the raised lip 306, and the slip buttons 310, if used. As used herein, the term "degradable" and all of its grammatical variants (e.g., "degrade," "degradation," "degrading," "dissolve," dissolving," and the like) refers to the dissolution or chemical conversion of solid materials such that a reduced-mass solid end product results from at least one of solubilization, hydrolytic degradation, biologically formed entities (e.g., bacteria or enzymes), chemical reactions (including electrochemical and galvanic reactions), thermal reactions, or reactions induced by radiation. In complete degradation, no solid end products result. In some instances, the degradation of the material may be sufficient for the mechanical properties of the material to be reduced to a point that the material no longer maintains its integrity and, in essence, falls apart or sloughs off to its surroundings. The conditions for degradation are generally wellbore 106 conditions where an external stimulus may be used to initiate or effect the rate of degradation. For example, the pH of the fluid that interacts with the material may be changed by introduction of an acid or a base. The term "wellbore environment" includes both naturally occurring wellbore 106 environments and materials or fluids introduced into the wellbore 106. As discussed in detail below, degradation of the degradable materials identified herein may be accelerated, rapid, or normal, degrading anywhere from about 30 minutes to about 40 days from first contact with the appropriate wellbore 106 environment or stimulant.

In some embodiments, two or more of the components of the device 116 may exhibit the same or substantially the same degradation rate and, therefore, may be configured to degrade at about the same rate. In other embodiments, one or more of the components may be configured to degrade or dissolve at a degradation rate that is different from the other components. In at least one embodiment, the barrel seal 204 that anchors the device 116 in the wellbore 106 may exhibit a degradation rate that is lower (i.e., slower) than the degradation rate of the wedge member 202 and the setting sleeve 208 (if used). As will be appreciated, this may prove advantageous in avoiding having portions of the device 116 prematurely detach from the wellbore 106 and flow uphole.

Suitable degradable materials that may be used in the components of the device 116 include borate glass, degradable polymers (e.g., polyglycolic acid (PGA), polylactic acid (PLA), etc.), degradable rubbers, galvanically-corrodible metals, dissolvable metals, dehydrated salts, and any combination thereof. The degradable materials may be configured to degrade by a number of mechanisms including, but not limited to, swelling, dissolving, undergoing a chemical change, electrochemical reactions, undergoing thermal degradation, or any combination of the foregoing.

Degradation by swelling involves the absorption by the degradable material of aqueous fluids or hydrocarbon fluids present within the wellbore environment such that the mechanical properties of the degradable material degrade or fail. Exemplary hydrocarbon fluids that may swell and degrade the degradable material include, but are not limited to, crude oil, a fractional distillate of crude oil a saturated hydrocarbon, an unsaturated hydrocarbon, a branched hydrocarbon, a cyclic hydrocarbon, and any combination thereof. Exemplary aqueous fluids that may swell the degradable material into degradation include, but are not limited to, fresh water, saltwater (e.g., water containing one or more salts dissolved therein), brine (e.g., saturated salt water), seawater, acids, bases, or combinations thereof. In degradation by swelling, the degradable material continues to absorb the aqueous and/or hydrocarbon fluid until its mechanical properties are no longer capable of maintaining the integrity of the degradable material and it at least partially falls apart. In some embodiments, the degradable material may be designed to only partially degrade by swelling in order to ensure that the mechanical properties of the component formed from the degradable material is sufficiently capable of lasting for the duration of the specific operation in which it is used.

Degradation by dissolving involves a degradable material that is soluble or otherwise susceptible to an aqueous fluid or a hydrocarbon fluid, such that the aqueous or hydrocarbon fluid is not necessarily incorporated into the degradable material (as is the case with degradation by swelling), but becomes soluble upon contact with the aqueous or hydrocarbon fluid.

Degradation by undergoing a chemical change may involve breaking the bonds of the backbone of the degradable material (e.g., a polymer backbone) or causing the bonds of the degradable material to crosslink, such that the degradable material becomes brittle and breaks into small pieces upon contact with even small forces expected in the wellbore environment.

Thermal degradation of the degradable material involves a chemical decomposition due to heat, such as the heat present in a wellbore environment. Thermal degradation of some degradable materials mentioned or contemplated herein may occur at wellbore environment temperatures that exceed about 93° C. (or about 200° F.).

Suitable degradable plastics or polymers for the components of the device 116 may include, but are not limited to, polyglycolic acid (PGA) and polylactic acid (PLA), and thiol-based plastics. A polymer is considered to be "degradable" if the degradation is due to, in situ, a chemical and/or radical process such as hydrolysis, oxidation, or UV radiation. Degradable polymers, which may be either natural or synthetic polymers, include, but are not limited to, polyacrylics, polyamides, and polyolefins such as polyethylene, polypropylene, polyisobutylene, and polystyrene. Suitable examples of degradable polymers that may be used in accordance with the embodiments of the present invention include polysaccharides such as dextran or cellulose, chitins, chitosans, proteins, aliphatic polyesters, poly(lactides), poly(glycolides), poly(s-caprolactones), poly(hydroxybutyrates), poly(anhydrides), aliphatic or aromatic polycarbonates, poly(orthoesters), poly(amino acids), poly(ethylene oxides), polyphosphazenes, poly(phenyllactides), polyepichlorohydrins, copolymers of ethylene oxide/polyepichlorohydrin, terpolymers of epichlorohydrin/ethylene oxide/allyl glycidyl ether, and any combination thereof. Of these degradable polymers, as mentioned above, PGA and PLA may be preferred. Polyglycolic acid and polylactic acid tend to degrade by hydrolysis as the temperature increases.

Polyanhydrides are another type of particularly suitable degradable polymer useful in the embodiments of the present disclosure. Polyanhydride hydrolysis proceeds, in situ, via free carboxylic acid chain-ends to yield carboxylic acids as final degradation products. The degradation time can be varied over a broad range with changes in the polymer backbone. Examples of suitable polyanhydrides include poly(adipic anhydride), poly(suberic anhydride), poly(sebacic anhydride), and poly(dodecanedioic anhydride). Other suitable examples include, but are not limited to, poly (maleic anhydride) and poly(benzoic anhydride).

Suitable degradable rubbers include degradable natural rubbers (i.e., cis-1,4-polyisoprene) and degradable synthetic rubbers, which may include, but are not limited to, ethylene propylene diene M-class rubber, isoprene rubber, isobutylene rubber, polyisobutene rubber, styrene-butadiene rubber, silicone rubber, ethylene propylene rubber, butyl rubber, norbornene rubber, polynorbornene rubber, a block polymer of styrene, a block polymer of styrene and butadiene, a block polymer of styrene and isoprene, and any combination thereof. Other suitable degradable polymers include those that have a melting point that is such that it will dissolve at the temperature of the subterranean formation in which it is placed.

In some embodiments, the degradable material may have a thermoplastic polymer embedded therein. The thermoplastic polymer may modify the strength, resiliency, or modulus of the component and may also control the degradation rate of the component. Suitable thermoplastic polymers may include, but are not limited to, an acrylate (e.g., polymethylmethacrylate, polyoxymethylene, a polyamide, a polyolefin, an aliphatic polyamide, polybutylene terephthalate, polyethylene terephthalate, polycarbonate, polyester, polyethylene, polyetheretherketone, polypropylene, polystyrene, polyvinylidene chloride, styrene-acrylonitrile), polyurethane prepolymer, polystyrene, poly(o-methylstyrene), poly (m-methylstyrene), poly(p-methylstyrene), poly(2,4-dimethylstyrene), poly(2,5-dimethylstyrene), poly(p-tert-butylstyrene), poly(p-chlorostyrene), poly(a-methylstyrene), co- and ter-polymers of polystyrene, acrylic resin, cellulosic resin, polyvinyl toluene, and any combination thereof. Each of the foregoing may further comprise acrylonitrile, vinyl toluene, or methyl methacrylate. The amount of thermoplastic polymer that may be embedded in the degradable material forming the component may be any amount that confers a desirable elasticity without affecting the desired amount of degradation.

With respect to galvanically-corrodible metals used as a degradable material, the galvanically-corrodible metal may be configured to degrade via an electrochemical process in which the galvanically-corrodible metal corrodes in the presence of an electrolyte (e.g., brine or other salt-containing fluids present within the wellbore 106). Suitable galvanically-corrodible metals include, but are not limited to, magnesium alloys, aluminum alloys, zinc alloys, and iron alloys. The rate of galvanic corrosion can be accelerated by alloying these alloys with a dopant. Suitable dopants to accelerate the corrosion rate include, but are not limited to, gold, gold-platinum alloys, silver, nickel, nickel-copper alloys, nickel-chromium alloys, copper, copper alloys (e.g., brass, bronze, etc.), chromium, tin, aluminum, iron, zinc, and beryllium. As the foregoing materials can be alloyed together or alloyed with other materials to control their rates of corrosion. Suitable galvanically-corrodible metals also include micro-galvanic metals or materials, such as nano-structured matrix galvanic materials. One example of a nano-structured matrix micro-galvanic material is a magnesium alloy with iron-coated inclusions.

Suitable galvanically-corrodible metals also include micro-galvanic metals or materials, such as a solution-structured galvanic material. An example of a solution-structured galvanic material is zirconium (Zr) containing a magnesium (Mg) alloy, where different domains within the alloy contain different percentages of Zr. This leads to a galvanic coupling between these different domains, which causes micro-galvanic corrosion and degradation. Micro-galvanically corrodible Mg alloys could also be solution structured with other elements such as zinc, aluminum, nickel, iron, calcium, carbon, tin, silver, palladium, copper, titanium, rare earth elements, etc. Micro-galvanically-corrodible aluminum alloys could be in solution with elements such as nickel, iron, calcium, carbon, tin, silver, copper, titanium, gallium, etc.

Suitable dissolvable or degradable metals for the components of the device 116 may be metals that dissolve in the wellbore fluid or the wellbore environment. For example, metal alloys with high composition in aluminum, magnesium, zinc, silver, or copper may be prone to dissolution in a wellbore environment. The degradable material may comprise dissimilar metals that generate a galvanic coupling that either accelerates or decelerates the degradation or dissolution rate of the components of the device 116. As will be appreciated, such embodiments may depend on where the dissimilar metals lie on the galvanic potential. In at least one embodiment, a galvanic coupling may be generated by embedding a cathodic substance or piece of material into an anodic structural element. For instance, the galvanic coupling may be generated by dissolving aluminum in gallium. A galvanic coupling may also be generated by using a sacrificial anode coupled to the degradable material. In such embodiments, the degradation rate of the degradable material may be decelerated until the sacrificial anode is dissolved or otherwise corroded away. In at least one embodiment, the components of the device 116 may comprise an aluminum-gallium alloy configured to dissolve in the wellbore environment.

In some embodiments, the degradable material may release an accelerant during degradation that accelerates the degradation of the component itself or an adjacent component of the device 116. In at least one embodiment, for instance, one or more of the components of the device 116 may be configured to release the accelerant to initiate and accelerate degradation of its own degradable material. In other cases, the accelerant may be embedded in the degradable material of one or more of the components and gradually released as the corresponding component degrades. In some embodiments, for example, the accelerant is a natural component released upon degradation of the degradable material, such as an acid (e.g., release of an acid upon degradation of the degradable material formed from a polylactide). Similarly, degradation of the degradable material may release a base that would aid in degrading the component, such as, for example, if the degradable material were composed of a galvanically-corrodible or reacting metal or material. As will be appreciated, the accelerant may comprise any form, including a solid form or a liquid form.

Suitable accelerants may include, but are not limited to, a chemical, a crosslinker, sulfur, a sulfur-releasing agent, a peroxide, a peroxide releasing agent, a catalyst, an acid releasing agent, a base releasing agent, and any combination thereof. In some embodiments, the accelerant may cause the degradable material to become brittle to aid in degradation. Specific accelerants may include, but are not limited to, a polylactide, a polyglycolide, an ester, a cyclic ester, a diester, an anhydride, a lactone, an amide, an anhydride, an alkali metal alkoxide, a carbonate, a bicarbonate, an alcohol, an alkali metal hydroxide, ammonium hydroxide, sodium hydroxide, potassium hydroxide, an amine, an alkanol amine, an inorganic acid or precursor thereof (e.g., hydrochloric acid, hydrofluoric acid, ammonium bifluoride, and the like), an organic acid or precursor thereof (e.g., formic acid, acetic acid, lactic acid, glycolic acid, aminopolycarboxylic acid, polyaminopolycarboxylic acid, and the like), and any combination thereof.

In some embodiments, the degradable material, including any additional material that may be embedded therein, may be present in a given component of the device 116 uniformly (i.e., distributed uniformly throughout). In other embodiments, however, the degradable material and any additional material embedded therein may be non-uniformly distributed throughout one or more of the components such that one portion or section of a given component degrades faster or slower than adjacent portions or sections. The choices and relative amounts of each composition or substance may be adjusted for the particular downhole operation (e.g., fracturing, work-over, and the like) and the desired degradation rate (i.e., accelerated, rapid, or normal) of the degradable material for the component. Factors that may affect the selection and amount of compositions or substances may include, for example, the temperature of the subterranean formation in which the downhole operation is being performed, the expected amount of aqueous and/or hydrocarbon fluid in the wellbore environment, the amount of elasticity required for the component (e.g., based on wellbore diameter, for example), and the like.

In some embodiments, blends of certain degradable materials may also be suitable as the degradable material for the components of the device 116. One example of a suitable blend of degradable materials is a mixture of PLA and sodium borate where the mixing of an acid and base could result in a neutral solution where this is desirable. Another example may include a blend of PLA and boric oxide. The choice of blended degradable materials also can depend, at least in part, on the conditions of the well, e.g., wellbore temperature. For instance, lactides have been found to be suitable for lower temperature wells, including those within the range of 60° F. to 150° F., and PLAs have been found to be suitable for well bore temperatures above this range. Also, PLA may be suitable for higher temperature wells. Some stereoisomers of poly(lactide) or mixtures of such stereoisomers may be suitable for even higher temperature applications. Dehydrated salts may also be suitable for higher temperature wells. Other blends of degradable materials may include materials that include different alloys including using the same elements but in different ratios or with a different arrangement of the same elements.

In some embodiments, the degradable material may be at least partially encapsulated in a second material or "sheath" disposed on all or a portion of a given component of the device 116. The sheath may be configured to help prolong degradation of the given component of the device 116, but may also serve to protect the components of the device 116 from abrasion within the wellbore 106. The sheath may be permeable, frangible, or comprise a material that is at least partially removable at a desired rate within the wellbore environment. In either scenario, the sheath may be designed such that it does not interfere with the ability of the components of the device 116 to form a fluid seal in the wellbore 106.

The sheath may comprise any material capable of use in a downhole environment. In at least one embodiment, the sheath may comprise rubber or an elastomer, which may prove advantageous in helping the components of the device 116 make a more fluid tight seal against the casing 114. Other suitable materials for the sheath include, but are not limited to, a TEFLON® coating, a wax, an elastomer, a drying oil, a polyurethane, an epoxy, a crosslinked partially hydrolyzed polyacrylic, a silicate material, a glass, an inorganic durable material, a polymer, polylactic acid, polyvinyl alcohol, polyvinylidene chloride, a hydrophobic coating, paint, an electrochemical coating, and any combination thereof. Suitable examples of electrochemical coatings include, but are not limited to, electroplating, electroless electroplating, anodic oxidation, anodic plasma-chemical, chemical vapor deposition, and combinations thereof.

In some embodiments, all or a portion of the outer surface of at least one of the components of the device 116 may be treated to impede degradation. For example, the outer surface of the given component may undergo a treatment that aids in preventing the degradable material (e.g., a galvanically-corrodible metal) from galvanically-corroding. Suitable treatments include, but are not limited to, an anodizing treatment, an oxidation treatment, a chromate conversion treatment, a dichromate treatment, a fluoride anodizing treatment, a hard anodizing treatment, and any combination thereof. Some anodizing treatments may result in an anodized layer of material being deposited on the outer surface of the given component. The anodized layer may comprise materials such as, but not limited to, ceramics, metals, polymers, epoxies, elastomers, or any combination thereof and may be applied using any suitable processes known to those of skill in the art. Examples of suitable processes that result in an anodized layer include, but are not limited to, soft anodize coating, anodized coating, electroless nickel plating, hard anodized coating, ceramic coatings, carbide beads coating, plastic coating, thermal spray coating, high velocity oxygen fuel (HVOF) coating, a nano HVOF coating, a metallic coating.

In some embodiments, all or a portion of the outer surface of at least one of the components of the device 116 may be treated or coated with a substance configured to enhance degradation of the degradable material. For example, such a treatment or coating may be configured to remove a protective coating or treatment or otherwise accelerate the degradation of the degradable material of the given component. An example is a galvanically-corroding metal material coated with a layer of PGA. In this example, the PGA would undergo hydrolysis and cause the surrounding fluid to become more acidic, which would accelerate the degradation of the underlying metal.

While the foregoing discussion provides degradable materials and configurations for the components of the device 116, it will be appreciated that the wellbore projectile 412 may also be made of a degradable or dissolvable material, without departing from the scope of the disclosure.

In some embodiments, the components of the device 116 may be made of two or more materials, such as a combination of a metal and a plastic. In other embodiments, the components of the device 116 may be made of a material that forms a metal-to-metal matrix or is bi-metallic. Suitable materials in such embodiments include, but are not limited to a boron-reinforced metal. A bi-metallic combination may also be created by having the center, downward, and upward elements constructed from different materials. For example, the central element could be composed of a degradable magnesium alloy and the side elements may be composed from a degradable tin alloy. The different galvanic potentials would control the rate of degradation and the location where the degradation would first occur. In other embodiments, the material of the components of the device 116 may be a composite material and otherwise include a reinforcing material to provide additional stiffness and sealing pressure.

In some embodiments, the barrel seal 204 may be made of two or more materials. For example, the body 302 (FIG. 3) may be made of a first material and the raised lip 306 (FIG. 3) may be made of a second material that exhibits a lower modulus of elasticity as compared to the first material. In such cases, the raised lip 306 may be better suited to plastically deform and aid in sealing against the inner wall 410 of the casing 114. In other embodiments, the body 302 may be made of a first material and the body 302 may be coated with a second material that exhibits the lower modulus of elasticity as compared to the first material.

In yet other embodiments, a third material may be positioned at the interface between the wedge member 202 and the barrel seal 204 (either on wedge member 202 or the barrel seal 204, or both) and configured to achieve friction or sealing needs between the two components. In such embodiments, the outer surface of the wedge member 202 may be coated with rubber or an elastomer, which may enhance the seal between the wedge member 202 and the barrel seal 204. The third material may also be configured to increase the friction in the releasing direction and allow for a steeper sticking taper between the wedge member 202 and the barrel seal 204. As will be appreciated, this may allow for a shorter device 116 and, therefore, save on manufacturing and material costs. In such embodiments, the third material may comprise shaped particles of metallic glass, for example, which may also be dissolvable over time. As will be appreciated, the third material could alternatively be added between the barrel seal 204 and the slip and the inner wall 410 of the casing 114.

Embodiments disclosed herein include:

A. A wellbore isolation device that includes a wedge member that defines an outer surface, and a barrel seal having a cylindrical body that provides an inner radial surface, an outer radial surface, and a plurality of longitudinally extending grooves defined through the body in an alternating configuration at opposing ends of the body, wherein the inner radial surface is engageable with the outer surface of the wedge member, and wherein at least one of the wedge member and the barrel seal is made of a degradable material that degrades when exposed to a wellbore environment.

B. A system that includes a wellbore isolation device extendable within a wellbore, the wellbore isolation device including a wedge member that defines an outer surface, and a barrel seal having a cylindrical body that provides an inner radial surface, an outer radial surface, and a plurality of longitudinally extending grooves defined through the body in an alternating configuration at opposing ends of the body, and a setting tool operatively coupled to the barrel seal to axially move the barrel seal with respect to the wedge member and thereby radially expand the barrel seal toward an inner wall of a casing that lines the wellbore, wherein the inner radial surface is engageable with the outer surface of the wedge member, and wherein at least one of the wedge member and the barrel seal is made of a degradable material that degrades when exposed to a wellbore environment.

C. A method that includes conveying a wellbore isolation device into a wellbore, the wellbore isolation device including a wedge member that defines an outer surface, and a barrel seal having a cylindrical body that provides an inner radial surface, an outer radial surface, and a plurality of longitudinally extending grooves defined through the body in an alternating configuration at opposing ends of the body, actuating a setting tool operatively coupled to the barrel seal and thereby moving the barrel seal in a first direction with respect to the wedge member, radially expanding the barrel seal toward an inner wall of a casing that lines the wellbore as the inner radial surface of the barrel seal slidingly engages the outer surface of the wedge member in the first direction, engaging the inner wall of the casing with the barrel seal and thereby generating a seal between axially adjacent zones within the wellbore, wherein at least one of the wedge member and the barrel seal is made of a degradable material that degrades when exposed to a wellbore environment.

Each of embodiments A, B, and C may have one or more of the following additional elements in any combination: Element 1: further comprising a setting sleeve engageable with a lower end of the barrel seal, and a setting tool coupled to the setting sleeve and operable to axially move the barrel seal with respect to the wedge member and thereby radially expand the barrel seal. Element 2: further comprising a setting tool operatively coupled to the barrel seal to axially move the barrel seal with respect to the wedge member and thereby radially expand the barrel seal. Element 3: wherein at least one of the outer surface of the wedge member and the inner radial surface of the body is tapered to provide a sticking taper that prevents the wedge member from disengaging from the barrel seal. Element 4: further comprising a raised lip that protrudes radially from the outer radial surface and circuitously extends about a circumference of the body. Element 5: wherein the raised lip comprises a wire or elastomer coupled to the outer radial surface of the body. Element 6: wherein the body is made of a first degradable material and the raised lip is made of a second degradable material that exhibits a lower modulus of elasticity as compared to the first degradable material. Element 7: further comprising a plurality of slip buttons positioned on the outer radial surface of the barrel seal, wherein each slip button comprises a hard material selected from the group consisting of ceramic, natural diamond, synthetic diamond, carbide, a metal, a degradable material, a crushed or shaped material, and any combination thereof. Element 8: further comprising a plurality of ramped teeth defined on one or both of the outer surface of the wedge member and the inner radial surface of the body to prevent the barrel seal from retracting from a set configuration on the wedge member. Element 9: wherein the degradable material is selected from the group consisting of borate glass, a degradable polymer, a degradable rubber, a galvanically-corrodible metal, a dissolvable metal, a dehydrated salt, a blend of dissimilar metals that generates a galvanic coupling, and any combination thereof.

Element 10: further comprising a setting sleeve engageable with a lower end of the barrel seal and coupled to the setting tool. Element 11: wherein at least one of the outer surface of the wedge member and the inner radial surface of the body is tapered to provide a sticking taper that prevents the wedge member from disengaging from the barrel seal. Element 12: wherein the degradable material is selected from the group consisting of borate glass, a degradable polymer, a degradable rubber, a galvanically-corrodible metal, a dissolvable metal, a dehydrated salt, a blend of dissimilar metals that generates a galvanic coupling, and any combination thereof. Element 13: further comprising a wellbore projectile receivable on a seat defined on an upper end of the wedge member to seal a central passageway through the wellbore isolation device. Element 14: further comprising a raised lip that protrudes radially from the outer radial surface and circuitously extends about a circumference of the body. Element 15: further comprising a plurality of slip buttons positioned in a corresponding plurality of holes defined in the outer radial surface of the body.

Element 16: wherein engaging the inner wall of the casing with the barrel seal comprises engaging the inner wall of the casing with a raised lip that protrudes radially from the outer radial surface, the raised lip circuitously extending about a circumference of the body. Element 17: wherein the raised lip comprises a high-strength material, the method further comprising providing slip resistance to the wellbore isolation device within the wellbore with the high-strength material. Element 18: wherein the raised lip comprises a soft metal or an elastomer, the method further comprising forming the seal between axially adjacent zones within the wellbore with the raised lip. Element 19: wherein engaging the inner wall of the casing with the barrel seal comprises engaging the inner wall of the casing with a plurality of slip buttons positioned on the outer radial surface of the body, and grippingly engaging the inner wall of the casing with the slip buttons and thereby providing slip resistance to the wellbore isolation device within the wellbore. Element 20: further comprising detaching the setting tool and retracting the setting tool from the wellbore, introducing a wellbore projectile into the wellbore and landing the wellbore projectile on a seat defined on an upper end of the wedge member, and increasing a fluid pressure within the wellbore to force the wedge member further within the barrel seal and thereby secure the wellbore isolation device against the inner wall of the casing. Element 21: wherein at least one of the outer surface of the wedge member and the inner radial surface of the body is tapered to provide a sticking taper, the method further comprising preventing the barrel seal from moving with respect to the wedge member in a second direction opposite the first direction with the sticking taper.

By way of non-limiting example, exemplary combinations applicable to A, B, and C include: Element 4 with Element 5; Element 4 with Element 6; Element 16 with Element 17; and Element 16 with Element 18.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A wellbore isolation device, comprising:

a wedge member that defines an outer surface; and a barrel seal having a cylindrical body that provides an inner radial surface, an outer radial surface, and a plurality of longitudinally extending grooves defined through the body in an alternating configuration at opposing ends of the body, wherein the inner radial surface is engageable with the outer surface of the wedge member, and wherein at least one of the wedge member and the barrel seal is made of a degradable material that degrades when exposed to a wellbore environment, and a raised lip that protrudes radially from the outer radial surface and circuitously extends about a circumference of the body, wherein the raised lip comprises a wire or elastomer coupled to the outer radial surface of the body.

2. The wellbore isolation device of claim 1, further comprising:

a setting sleeve engageable with a lower end of the barrel seal; and a setting tool coupled to the setting sleeve and operable to axially move the barrel seal with respect to the wedge member and thereby radially expand the barrel seal.

3. The wellbore isolation device of claim 1, further comprising a setting tool operatively coupled to the barrel seal to axially move the barrel seal with respect to the wedge member and thereby radially expand the barrel seal.

4. The wellbore isolation device of claim 1, wherein at least one of the outer surface of the wedge member and the inner radial surface of the body is tapered to provide a sticking taper that prevents the wedge member from disengaging from the barrel seal.

5. The wellbore isolation device of claim 1, wherein the body is made of a first degradable material and the raised lip is made of a second degradable material that exhibits a lower modulus of elasticity as compared to the first degradable material.

6. The wellbore isolation device of claim 1, further comprising a plurality of slip buttons positioned on the outer radial surface of the barrel seal, wherein each slip button comprises a hard material selected from the group consisting of ceramic, natural diamond, synthetic diamond, carbide, a metal, a degradable material, a crushed or shaped material, and any combination thereof.

7. The wellbore isolation device of claim 1, further comprising a plurality of ramped teeth defined on one or both of the outer surface of the wedge member and the inner radial surface of the body to prevent the barrel seal from retracting from a set configuration on the wedge member.

8. The wellbore isolation device of claim 1, wherein the degradable material is selected from the group consisting of borate glass, a degradable polymer, a degradable rubber, a galvanically-corrodible metal, a dissolvable metal, a dehydrated salt, a blend of dissimilar metals that generates a galvanic coupling, and any combination thereof.

9. A system, comprising:

a wellbore isolation device extendable within a wellbore, the wellbore isolation device including a wedge member that defines an outer surface, and a barrel seal having a cylindrical body that provides an inner radial surface, an outer radial surface, and a plurality of longitudinally extending grooves defined through the body in an alternating configuration at opposing ends of the body; and a setting tool operatively coupled to the barrel seal to axially move the barrel seal with respect to the wedge member and thereby radially expand the barrel seal toward an inner wall of a casing that lines the wellbore, wherein the inner radial surface is engageable with the outer surface of the wedge member, and wherein at least one of the wedge member and the barrel seal is made of a degradable material that degrades when exposed to a wellbore environment, a wellbore projectile receivable on a seat defined on an upper end of the wedge member to seal a central passageway through the wellbore isolation device.

10. The system of claim 9, further comprising a setting sleeve engageable with a lower end of the barrel seal and coupled to the setting tool.

11. The system of claim 9, wherein at least one of the outer surface of the wedge member and the inner radial surface of the body is tapered to provide a sticking taper that prevents the wedge member from disengaging from the barrel seal.

12. The system of claim 9, wherein the degradable material is selected from the group consisting of borate glass, a degradable polymer, a degradable rubber, a galvanically-corrodible metal, a dissolvable metal, a dehydrated salt, a blend of dissimilar metals that generates a galvanic coupling, and any combination thereof.

13. The system of claim 9, further comprising a raised lip that protrudes radially from the outer radial surface and circuitously extends about a circumference of the body.

14. The system of claim 9, further comprising a plurality of slip buttons positioned in a corresponding plurality of holes defined in the outer radial surface of the body.

15. A method, comprising:

conveying a wellbore isolation device into a wellbore, the wellbore isolation device including a wedge member that defines an outer surface, and a barrel seal having a cylindrical body that provides an inner radial surface, an outer radial surface, and a plurality of longitudinally extending grooves defined through the body in an alternating configuration at opposing ends of the body;

actuating a setting tool operatively coupled to the barrel seal and thereby moving the barrel seal in a first direction with respect to the wedge member;

radially expanding the barrel seal toward an inner wall of a casing that lines the wellbore as the inner radial surface of the barrel seal slidingly engages the outer surface of the wedge member in the first direction;

engaging the inner wall of the casing with the barrel seal and thereby generating a seal between axially adjacent zones within the wellbore, wherein at least one of the wedge member and the barrel seal is made of a degradable material that degrades when exposed to a wellbore environment detaching the setting tool and retracting the setting tool from the wellbore;

introducing a wellbore projectile into the wellbore and landing the wellbore projectile on a seat defined on an upper end of the wedge member, and increasing a fluid pressure within the wellbore to force the wedge member further within the barrel seal and thereby secure the wellbore isolation device against the inner wall of the casing.

16. The method of claim 15, wherein engaging the inner wall of the casing with the barrel seal comprises engaging the inner wall of the casing with a raised lip that protrudes radially from the outer radial surface, the raised lip circuitously extending about a circumference of the body.

17. The method of claim 16, wherein the raised lip comprises a high-strength material, the method further comprising providing slip resistance to the wellbore isolation device within the wellbore with the high-strength material.

18. The method of claim 16, wherein the raised lip comprises a soft metal or an elastomer, the method further comprising forming the seal between axially adjacent zones within the wellbore with the raised lip.

19. The method of claim 15, wherein engaging the inner wall of the casing with the barrel seal comprises:

engaging the inner wall of the casing with a plurality of slip buttons positioned on the outer radial surface of the body; and grippingly engaging the inner wall of the casing with the slip buttons and thereby providing slip resistance to the wellbore isolation device within the wellbore.

20. The method of claim 15, wherein at least one of the outer surface of the wedge member and the inner radial surface of the body is tapered to provide a sticking taper, the method further comprising preventing the barrel seal from moving with respect to the wedge member in a second direction opposite the first direction with the sticking taper.

* * * * *